US007000537B2

(12) United States Patent
Sano

(10) Patent No.: US 7,000,537 B2
(45) Date of Patent: Feb. 21, 2006

(54) PRESS AND MACHINE TOOL

(75) Inventor: Sadao Sano, Kanagawa (JP)

(73) Assignee: Sodick Co., Ltd., Kanagawa (JP)

( * ) Notice: Subject to any disclaimer, the term of this patent is extended or adjusted under 35 U.S.C. 154(b) by 0 days.

(21) Appl. No.: 10/312,344

(22) PCT Filed: Mar. 22, 2002

(86) PCT No.: PCT/JP02/02761

§ 371 (c)(1),
(2), (4) Date: May 7, 2003

(87) PCT Pub. No.: WO02/090096

PCT Pub. Date: Nov. 14, 2002

(65) Prior Publication Data

US 2003/0164099 A1 Sep. 4, 2003

(30) Foreign Application Priority Data

Apr. 26, 2001 (JP) ..... 2001-129753

(51) Int. Cl.
*B30B 1/00* (2006.01)

(52) U.S. Cl. ..... 100/240; 72/404

(58) Field of Classification Search ..... 72/452.8, 72/452.9, 404; 74/110; 100/214, 210, 258 R, 100/280, 291, 257, 246, 252
See application file for complete search history.

(56) References Cited

U.S. PATENT DOCUMENTS 5,179,879 A * 1/1993 Yerly ..... 83/34
5,199,293 A 4/1993 Catti et al.
5,746,122 A * 5/1998 Gietz et al. ..... 100/43
5,915,296 A * 6/1999 Itakura ..... 100/209
6,003,359 A * 12/1999 Futamura et al. ..... 72/404
6,023,958 A * 2/2000 To et al. ..... 72/455
6,030,569 A 2/2000 Yu

FOREIGN PATENT DOCUMENTS

| | | | |
|---|---|---|---|
| DE | 3151920 | * | 7/1983 |
| EP | 0 943 422 A2 | | 9/1999 |
| JP | 59-110146 | | 7/1984 |
| JP | 292499 | * | 4/1990 |
| JP | 8-309620 | | 11/1996 |
| JP | 10-202397 A | | 8/1998 |

* cited by examiner

*Primary Examiner*—Derris H. Banks
*Assistant Examiner*—Shelley Self
(74) *Attorney, Agent, or Firm*—McDermott Will & Emery LLP; Paul Devinsky

(57) ABSTRACT

A press having a machine frame section (10) and a movable section capable of reciprocal movement in a vertical direction relative to the machine frame section, for making products using a pair of dies. The movable section includes a slide (24) to which one of the pair of dies is mounted, and a horizontal guide surface is formed on one of the machine frame section and the movable section. A drive slider (51, 52, 53, 54) has a horizontal sliding surface facing the horizontal guide surface and an inclined sliding surface inclined at a specified angle, and is movably joined to the one of the two sections. A swash plate (51, 52, 53, 54) has an inclined guide surface facing the inclined sliding surface, and is fixed to the other of the two sections. A linear motor (1*a*, 1*b*, 2*a*, 2*b*, 3*a*, 3*b*, 4*a*, 4*b*) causes the drive slider to reciplocate along the inclined guide surface of the swash plate through a larger stroke. Energy of the reciprocating drive slider causes the slide to vertically reciplocate through a smaller stroke with a larger pressure.

24 Claims, 6 Drawing Sheets

PRESS AND MACHINE TOOL

TECHNICAL FIELD

The present invention relates to a machine for producing a product by causing a movable section to reciprocate along a linear slide path using a linear motor. The present invention particularly relates to a press for forming a workpiece by reciprocating a slide on which one of dies is mounted using a linear motor, and to a machine tool for removing material from the metal workpiece by moving one of a tool and the workpiece relative to the other using a linear motor.

BACKGROUND ART

Generally, the upper die of a press is fitted to the bottom of a slide, while the lower die is fitted to the top of a bolster attached to a stationary machine frame. A feeder is connected with vertical reciprocation of a slide and feeds a workpiece between dies. Presses for causing reciprocation of the slide in the vertical direction using a linear motor have been increasingly made use of in recent years. Japanese Patent Laid-open No. 10-202397 discloses a press having six linear motors provided between an inner vertical surface of the machine frame and a vertical surface of the slide. This publication also discloses a press having two movers attached to the opposite vertical surfaces of connecting members. The connecting members are fixed to four guide posts extending vertically, and a slide is fixed to an upper part of the guide posts. Japanese Patent Laid-open No. 11-254191 discloses a press having four linear motors provided between an inner vertical surface of a machine frame and a vertical surface of a movable frame. Four guide posts extending vertically are fixed to the movable frame, and a slide is fixed to upper ends of the four guide posts. Japanese Patent Laid-open No. 2000-312992 discloses a press having a slide fixed to upper ends of the four vertically extending guide posts, and a pair of linear motors attached to each guide post.

Use of linear motors having excellent controllability brings a number of advantages to a press.

1. It is possible to obtain high precision because only a few components are required for power transmission.
2. Controlling a linear motor to allow high precision synchronization with peripheral devices such as a feeder for feeding a workpiece between dies is simple.
3. A pressure-stroke curve can be freely set using a numerical control unit.
4. Bottom dead center can be freely selected.
5. Stroke can be freely selected.

However, linear motors being used currently suffer from the shortcoming that they are incapable of generating large pressure. This means that conventionally it has been necessary to increase the number of linear motors in order to generate a large pressure.

DISCLOSURE OF THE INVENTION

The object of the present invention is to provide a press for generating a large pressure without causing an increase in the number of linear motors.

Working energy W is given by the product of force F and stroke S of a slide. In order to achieve the object of the present invention, a drive slider is caused to reciprocate through a large stroke S1 using the force F1 of a linear motor, and a slide that reciprocates through a stroke S2 smaller than the stroke S1 generates a force F2 larger than the force F1 using working energy W1 of the drive slider.

According to the present invention, a press having a machine frame section and a movable section capable of reciprocal movement in a vertical direction relative to the machine frame section, for making products using a pair of dies, comprises:

a first drive slider, having a horizontal sliding surface facing a horizontal guide surface formed on one of the machine frame section and the movable section and an inclined sliding surface inclined at a specified angle, movably joined to the one of the two sections, a first swash plate, having an inclined guide surface facing the inclined sliding surface, fixed to the other of the two sections, and a first linear motor for causing the first drive slider to move along the inclined guide surface of the first swash plate.

The movable section preferably includes a slide to which one of the pair of dies is mounted, a moving body to which the first drive slider is joined so as to move along the horizontal guide surface, and a plurality of vertically extending guide posts to which the slide and the moving body are fixed.

The first drive slider reciprocates through a larger stroke along the inclined sliding surface of the first swash plate under power from the first linear motor. Energy of the reciprocating first drive slider is transmitted to the slide, and the slide then reciprocates vertically along a stroke that is smaller that the stroke of the drive slider. As a result, the press can generate a larger pressure capacity.

The press of the present invention preferably comprises a second drive slider, having a horizontal sliding surface facing a horizontal guide surface and an inclined guide surface inclined to a specified angle, movably joined to one of the machine frame section and the movable section, a second swash plate, having an inclined guide surface facing the inclined sliding surface of the second drive slider, fixed to the other of the machine frame section and the movable section, and a second linear motor for causing the second drive slider to move along the inclined guide surface of the second swash plate. The first and second drive sliders are arranged parallel to each other, and the inclined sliding surfaces of the first and second drive sliders are inclined in opposite directions. As a result, undesirable vibration generated in the drive sliders is offset.

A linear motor drive mechanism for generating a larger force can also be applied to other machines besides a press. For example, it can also be applied to a machine tool, having a fixed section and a movable section capable of reciprocal movement relative to the fixed section along a linear slide path, for making products by removing material from a workpiece using a tool.

A machine tool of the present invention comprises:

a first swash plate, having a first inclined guide surface inclined at a specified angle to a guide plane which is formed on one of a fixed section and a movable section and makes a slide path a right angle, fixed to the other of the fixed section and the movable section, a first drive slider, having a first inclined sliding surface facing a first inclined guide surface, joined to the one of the two sections so as to move along the guide plane, and a first linear motor for causing the first drive slider to move along the first inclined guide surface.

Additional novel features and advantages of the invention will be set forth in the description that follows.

BEST MODE FOR CARRYING OUT THE INVENTION

Figure 1:
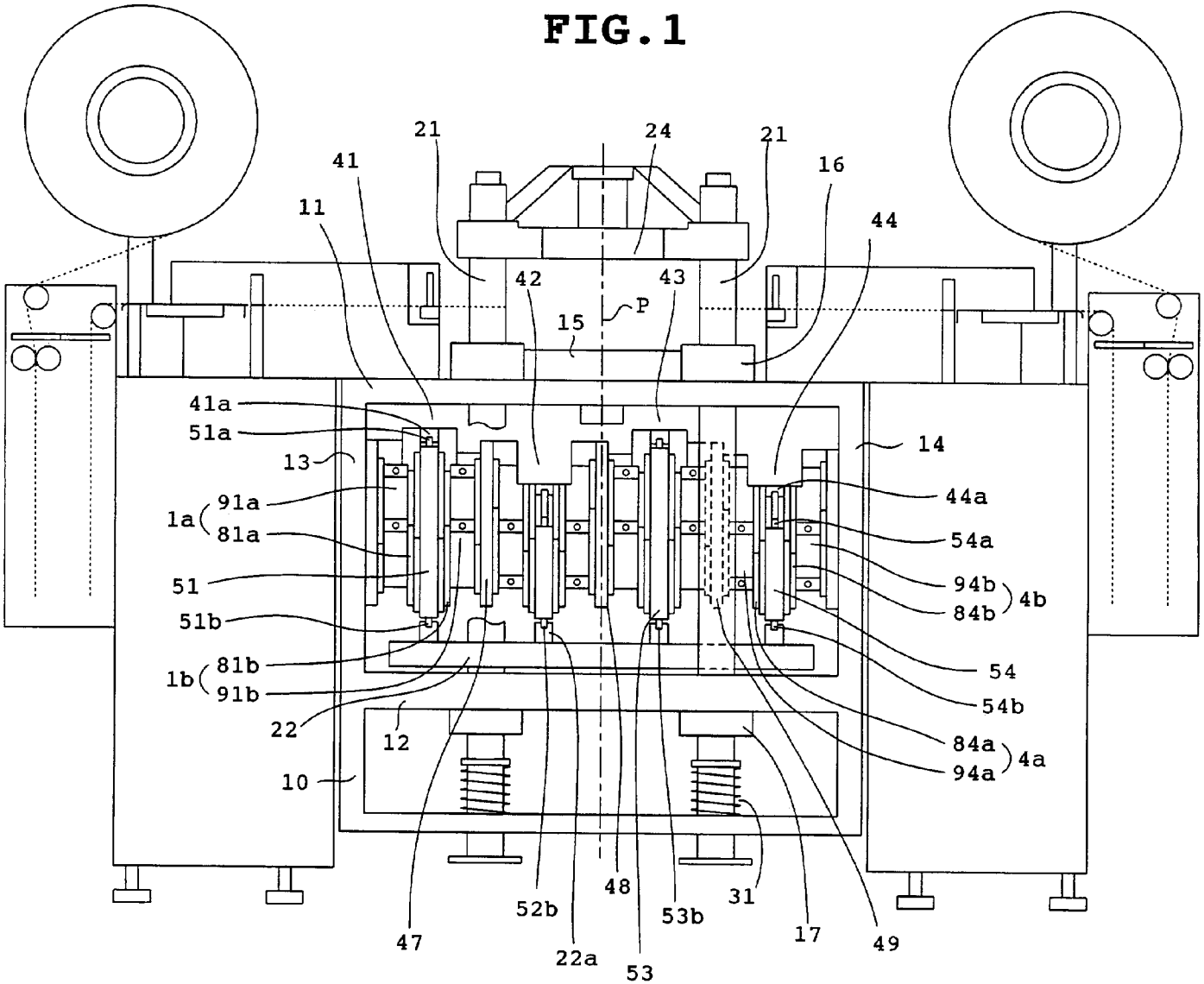
FIG. 1 is a front elevation illustrating a press of the present invention with a front wall removed.
Figure 2:
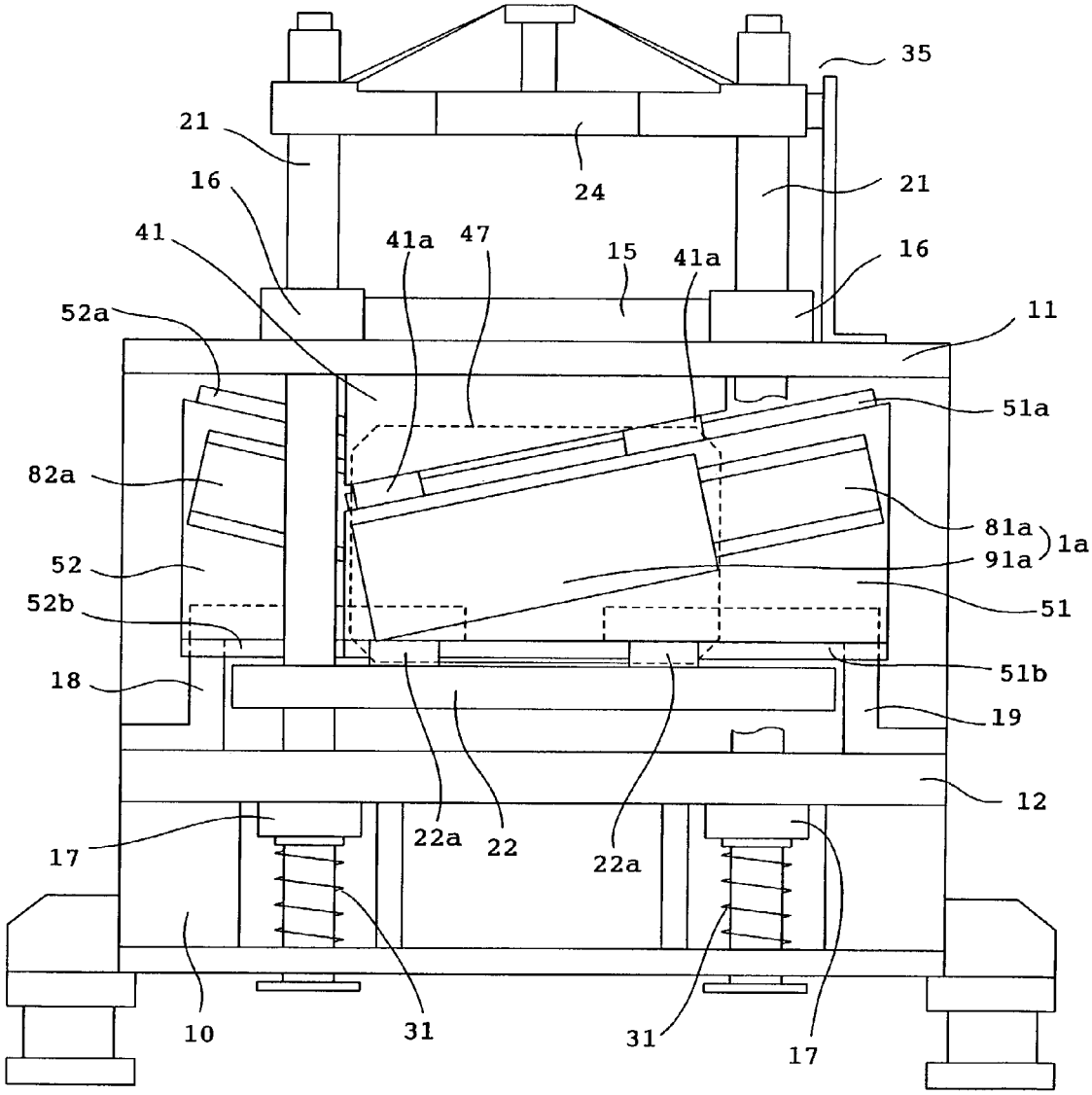
FIG. 2 is a left side elevation partially illustrating the press of FIG. 1 positioned at top dead center, with a left side wall removed.
Figure 3:
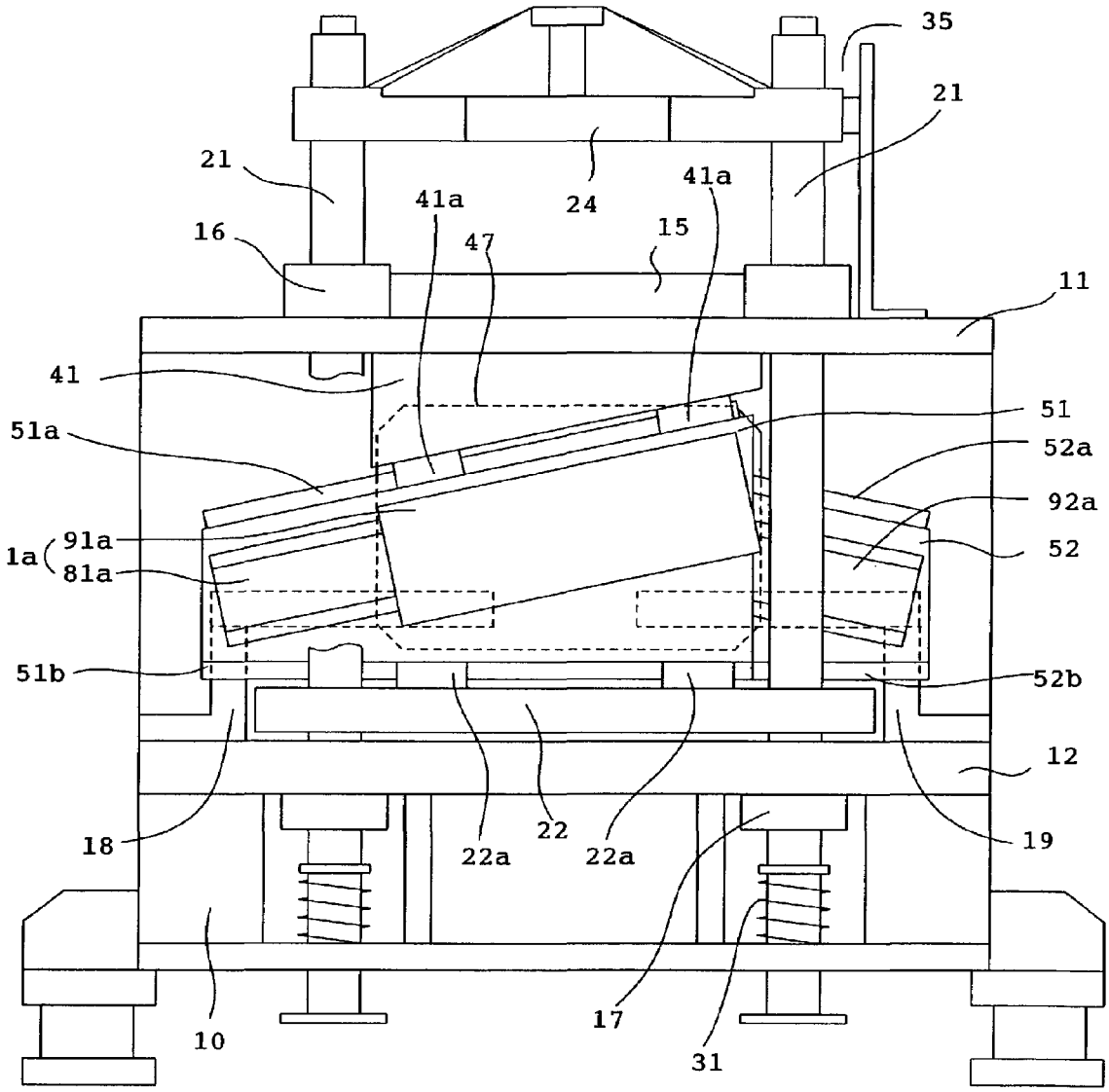
FIG. 3 is a left side elevation partially illustrating the press of FIG. 1 positioned at bottom dead center, with a left side wall removed.
Figure 4:
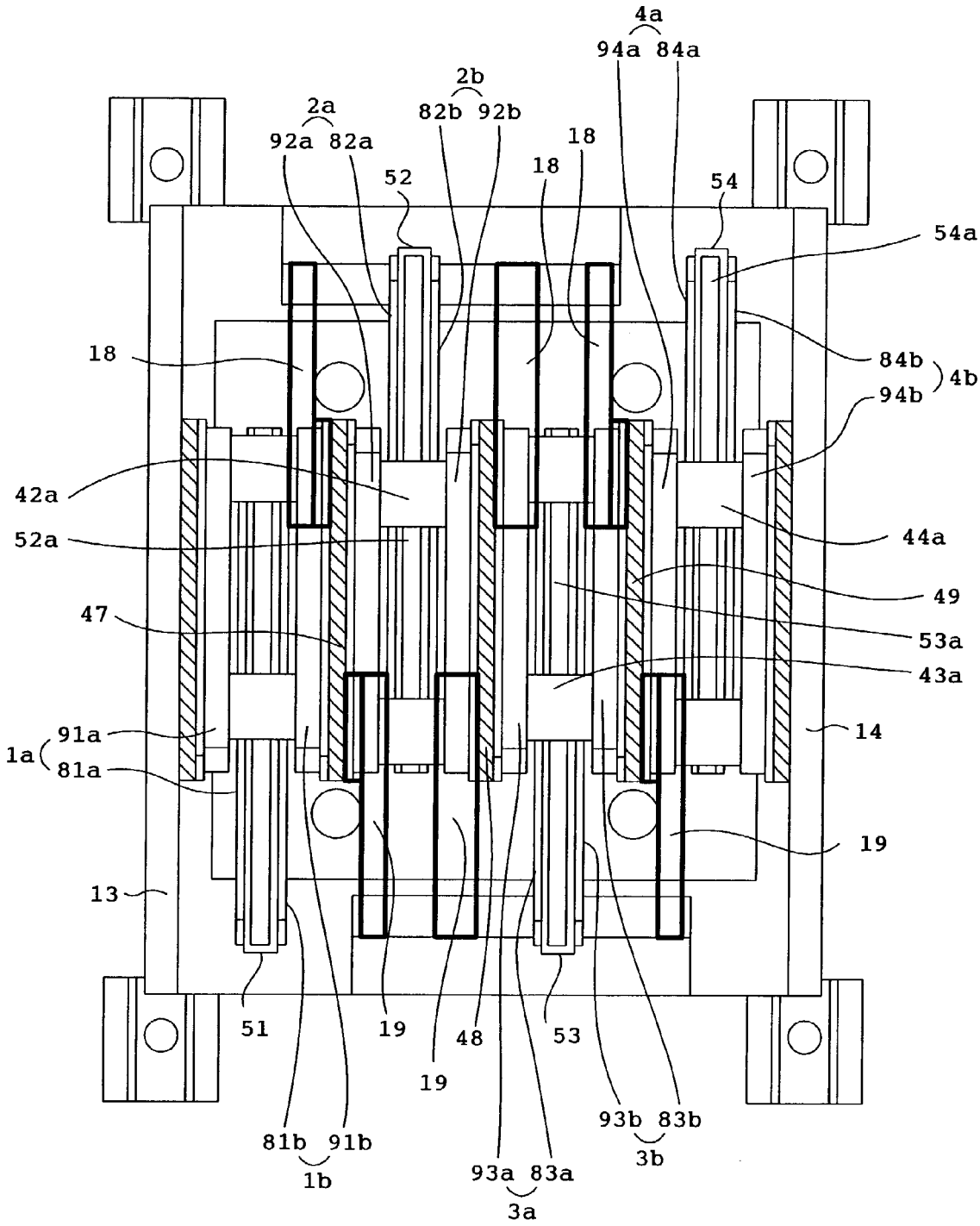
FIG. 4 is a plan view of the press of FIG. 1 looking downwards from a swash plate.
Figure 5:
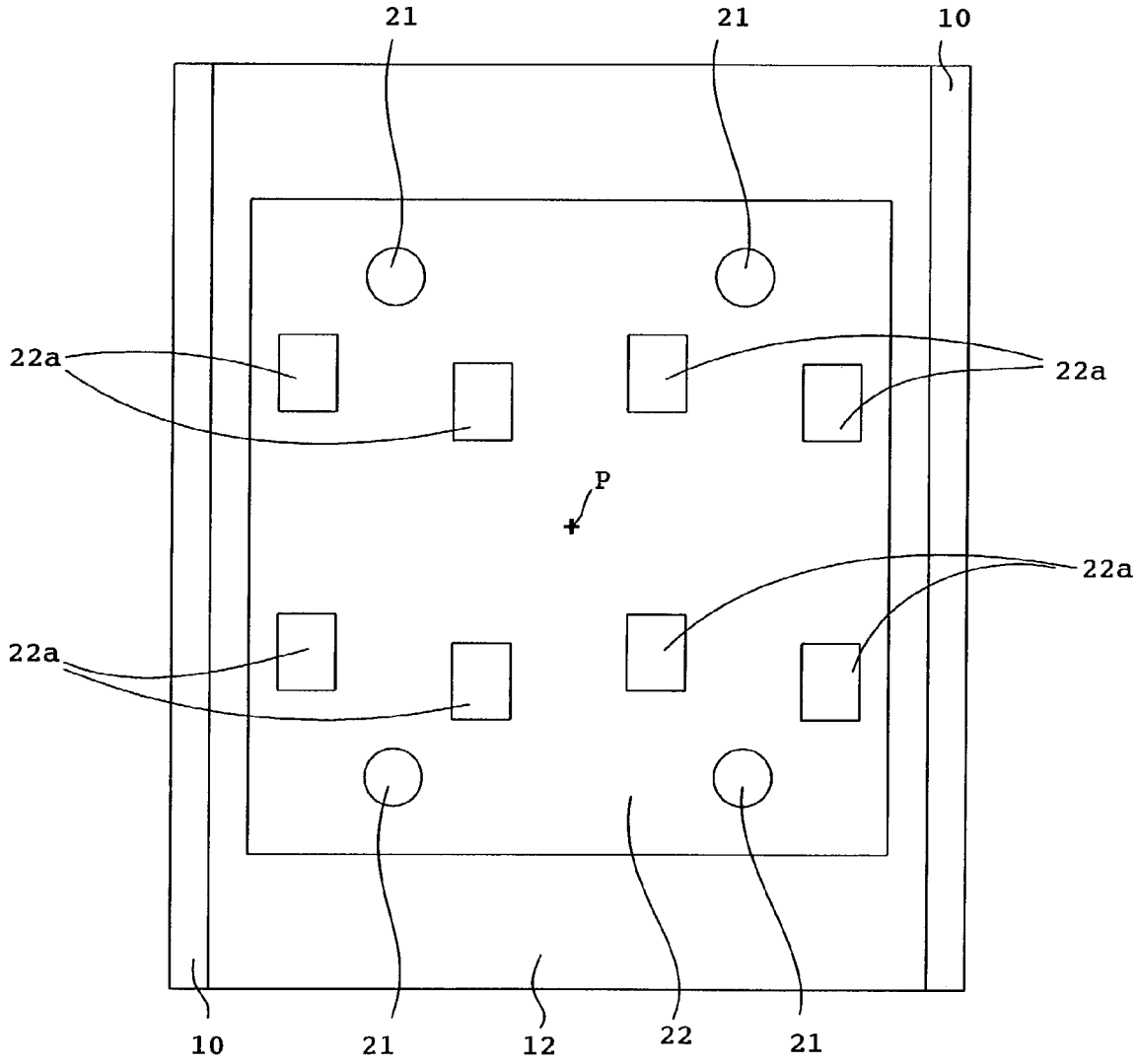
FIG. 5 is a plan view of the press of FIG. 1 looking downwards from a moving body.

A press of the present invention for forming a workpiece such as a metal sheet will now be described with reference to FIG. 1, FIG. 2, FIG. 3, FIG. 4 and FIG. 5.

A stationary machine frame 10 of the press includes horizontal machine base plates 11 and 12, and vertical side walls 13 and 14. Four guide posts 21 extend vertically through the machine base plates 11 and 12. Four guide members 16 are attached to the upper machine base plate 11, and four guide members 17 are attached to the lower machine base plate 12. A slide 24 is fixed to upper ends of the guide posts 21, and a bolster 15 is attached to the top of the upper machine base plate 11. An upper die is mounted on the bottom of the slide 24 while a lower die is mounted on the top of the bolster 15. A plate shaped moving body 22 that is movable in the vertical direction is integrally fixed to the guide posts 21, and positioned between the machine base plates 11 and 12. The slide 24, guide posts 21 and moving body 22 form a movable section that can move along a vertical slide path P. The moving body 22 has a guide plane making a right angle with the slide path P. Guide members 16 and 17, such as linear motion bearings, act in cooperation with the guide posts 21 to guide the movable section in a vertical direction. Using the moving body 22 and guide posts 21, it is possible to position the drive mechanism of the slide 24 lower than the dies. Such a press having a small height is called a bottom drive press. As a result of vertical reciprocation of the moving body 22, the slide 24 linked to the moving body 22 by the guide posts 21 is driven to reciprocate. As a result, a metal workpiece supplied between dies is formed into a desired shape. A position detector 35 for detecting position and speed in the slide path P of the slider 24 is provided between the machine base plate 11 and the slide 24.

The drive mechanism of the slide 24 includes drive sliders 51, 52, 53 and 54 movably engaging with the moving body 22, swash plates 41, 42, 43 and 44 fixed to the flat bottom of the upper machine base plate 11, and a linear motor for reciprocally driving the drive sliders 51, 52, 53 and 54 along inclined guide surfaces of the swash plates 41, 42, 43 and 44. The swash plates and drive sliders are preferably provided in groups of 2n (n=1, 2, 3, . . . ), for instance, as shown in the drawing a set of four swash plates and drive sliders are grouped together. The swash plates 41, 42, 43 and 44 are arranged in parallel between side walls 13 and 14, and have inclined guide surfaces at respective lower edges. The inclined guide surfaces are inclined at an angle to the horizontal, for example, 11.5°. The swash plates 41 and 43 have an inclined guide surface facing to the rear of the machine and downwards. While the swash plates 42 and 44 have inclined guide surfaces facing to the rear of the machine but rising up. The inclined guide surfaces of adjoining swash plates are thus inclined in opposite directions. The drive sliders 51, 52, 53 and 54 are arranged parallel to each other below the respective swash plates 41, 42, 43 and 44. The drive sliders have inclined sliding surfaces facing the inclined guide surfaces at respective upper edges, and can slide on the inclined guide surfaces. As a result, looking from the side surface of the machine, adjoining drive sliders move so as to cross in an X-shape. Guide rails 51*a*, 52*a*, 53*a* and 54*a* are provided on respective inclined sliding surfaces of the drive sliders 51, 52, 53 and 54. Four pairs of bearing blocks 41*a*, 42*a*, 43*a* and 44*a* capable of engaging respective guide rails 51*a*, 52*a*, 53*a* and 54*a* are respectively provided on inclined guide surfaces of the swash plates 41, 42, 43 and 44. The drive sliders 51, 52, 53 and 54 have horizontal sliding surfaces at respective lower edges. Guide rails 51*b*, 52*b*, 53*b* and 54*b* are provided on respective horizontal sliding surfaces. Four pairs of bearing blocks 22*a* capable of engaging respective guide rails 51*b*, 52*b*, 53*b* and 54*b* are attached to the upper horizontal guide plane of the moving body 22. The bearing blocks 41*a*, 42*a*, 43*a*, 44*a* and 22*a* have balls or rollers inside. The drive sliders 51, 52, 53 and 54 can move along the guide plane relative to the moving body 22, as well as engaging the moving body 22.

Linear motor movers 81*a* and 81*b* are attached to vertical surfaces on both sides of the drive slider 51. Similarly, movers 82*a* and 82*b* are attached to vertical surfaces on both sides of the drive slider 52, movers 83*a* and 83*b* are attached to vertical surfaces on both sides of the drive slider 53 and movers 84*a* and 84*b* are attached to vertical surfaces on both sides of the drive slider 54. The mover may include a soft magnetic iron plate on which a plurality of permanent magnets are affixed in a row in a moving direction. The movers 81*a*, 81*b*, 82*a*, 82*b*, 83*a*, 83*b*, 84*a* and 84*b* are spaced from respective stators 91*a*, 91*b*, 92*a*, 92*b*, 93*a*, 93*b*, 94*a* and 94*b* with microscopic gaps to form linear motors 1*a*, 1*b*, 2*a*, 2*b*, 3*a*, 3*b*, 4*a* and 4*b*. The stators may include iron cores formed by fastening silicon steel plate as a laminate, and a plurality of coils which are wound around the iron cores for each magnetic pole. The stator 91*a* is attached to an inner surface of a side wall 13. A mounting plate 47 is suspended from the machine base plate 11 between the swash plates 41 and 42. Similarly, a mounting plate 48 is provided between the swash plates 42 and 43, and a mounting plate 49 is provided between the swash plates 43 and 44. Stators 91*b* and 92*a* are attached to vertical surfaces of the mounting plate 47, stators 92*b* and 93*a* are attached to vertical surfaces of the mounting plate 48, and stators 93*b* and 94*a* are attached to vertical surfaces of the mounting plate 49. The stator 94*b* is attached to an inner surface of a side wall 14. A lower end of the mounting plate 47 is firmly fixed to the machine base plate 12 using hook-shaped fixtures 18 and 19 which are bent around the moving body 22. The other mounting plates 48 and 49 are also firmly fixed in a similar manner to the machine base plate 12 using fixtures 18 and 19. A pair of linear motors 1*a* and 1*b* are positioned so that it is possible to generate thrust parallel to the inclined sliding surface of the drive slider 51. Similarly, the other linear motors 2*a*, 2*b*, 3*a*, 3*c*, 4*a* and 4*b* are also positioned so as to be able to generate thrust parallel to the inclined sliding surfaces of the corresponding drive sliders 52, 53 and 54. Since a pair of linear motors are provided on vertical surfaces at both sides of the corresponding drive slider, magnetic attraction forces of respective linear motors are offset, and it is possible for the drive sliders to move smoothly.

Energy for moving a body is expressed by thrust and length of movement. Reciprocation over a longer stroke is produced in the drive sliders 51, 52, 53 and 54 using the linear motors. Reciprocation of the slider 24 over a smaller stroke is produced using the energy of the reciprocation over a longer stroke. This means that the slider 24 can produce a larger compressive force. For example, assume that the thrust of each linear motor 1*a*, 1*b*, 2*a*, 2*b*, 3*a*, 3*b*, 4*a* and 4*b* is 2,800 N, the inclination angle of the swash plates 41, 42, 43 and 44 is 11.5°, and the stroke of the drive sliders 51, 52, 53 and 54 is 200 mm. Even taking into consideration loss due to a coefficient of friction (about 0.01), it is possible to realize a large press capable of producing a pressure of 11 tons with a stroke of the slide 24 being about 40 mm.

When the movable section is raised, there is a possibility that a gap between the guide rails 51*a*, 52*a*, 53*a* and 54*a* and the bearing blocks 41*a*, 42*a*, 43*a* and 44*a*, and a gap between the guide rails 51*a*, 52*a*, 53*a* and 54*a* and the bearing block 22*a* will become larger. For this reason springs 31 to apply preload are provided between the machine frame 10 and each of the guide posts 21. It is also possible to provide an air balancer or an air cylinder controlled by an electro-pneumatic regulator for holding the movable section to the machine frame 10 against gravitational force, instead of the spring 31.

It is also possible to consider another embodiment where the drive sliders 51, 52, 53 and 54 are provided on the machine frame 10 in a movable manner, and the swash plates 41, 42, 43 and 44 are fixed to the movable section. With such an embodiment, the swash plates 41, 42, 43 and 44 are fixed to an upper flat surface of the moving body 22, and have inclined guide surfaces on respective upper edges. A horizontal guide plane is formed on the bottom of the upper machine base plate 11. The drive sliders 51, 52, 53 and 54 engage the machine base plate 11 so as to be capable of movement along the guide plane using appropriate guide rails and bearing blocks. The drive sliders 51, 52, 53 and 54 have inclined sliding surfaces at respective lower edges, and can move along the inclined guide surfaces of the swash plates 41, 42, 43 and 44 using the appropriate guide rails and bearing blocks. Differing from the illustrated embodiment, linear motors 1*a*, 1*b*, 2*a*, 2*b*, 3*a*, 3*b*, 4*a* and 4*b* are arranged so that the direction of thrust is horizontal.

Although only a bottom drive press has been illustrated, it is also possible to apply the present invention to a top drive press having the slide drive mechanism located above the dies. In this case, the movable section only comprises the slide 24, and the slide 24 slides on an inner surface of the machine frame 10 along a vertical slide path P. A guide plane is formed on one of either the machine frame 10 or the slide 24. The drive sliders 51, 52, 53 and 54 engage one of either the machine frame 10 or the slide 24 to be capable of moving along the guide plane. The swash plates 41, 42, 43 and 44 are fixed to the other one of the machine frame 10 or the slide 24.

The present invention can also be applied to other machines having a movable section driven to reciprocate along a linear slide path, for example, a machine tool.

Figure 6:
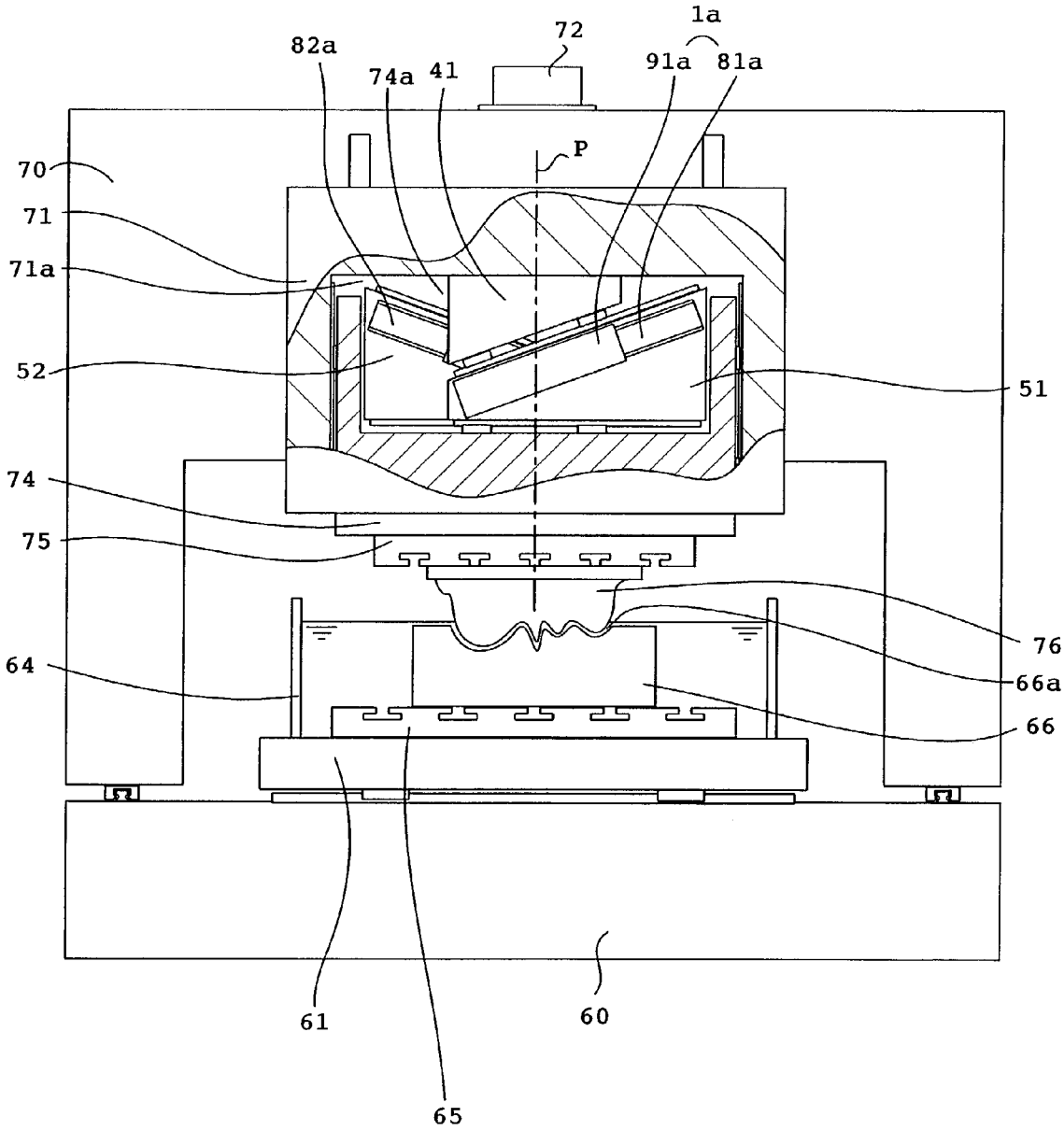
FIG. 6 is a front elevation illustrating a die sinker electric discharge machine of the present invention.

A sinker electric discharge machine, being one example of a machine tool to which the present invention is applied, will now be described with reference to FIG. 6.

Reference numerals that are the same as those in FIG. 1, FIG. 2, FIG. 3, FIG. 4 and FIG. 5 are used to represent the same elements, and detailed description thereof will be omitted.

A column 70 is provided on a bed 60 so as to be movable in a Y axis direction, and has a shape that bridges from one end of the bed 60 to the other. An X table 61 provided on the bed 60 can move in an X axis direction. A work tank 64 holding dielectric fluid is attached to the X table 61. A workpiece attachment plate 65 for attachment of a workpiece is fixed to the X table 61 inside the work tank 64. A head 71 provided on a front surface of the column 70 can be moved vertically by a drive motor 72. The head 71 has a slide hole 71*a* that is rectangular in cross section opening downwards. A slider 74 can slide within the slide hole 71*a* coaxially with the head 71 using appropriate guide rails and bearing blocks. A tool attachment unit 75 is fixed to a lower end of the slider 74, and a large tool electrode 76 is attached to the tool attachment unit 75. The slider 74 has a hole 74*a* opening upwards. A drive mechanism causing the slider 74 to reciprocate along a vertical slide path P is arranged inside the hole 74*a*. A guide plane making a right angle with the slide path P is formed at the bottom of the hole 74*a*. Upper edges of four swash plates 41 . . . are fixed to the head 71, and inclined guide surfaces are formed on the lower end of each swash plate 41 . . . . Four drive sliders 51, 52 . . . can be moved along the horizontal guide plane of the hole 74*a* by appropriate guide rails and bearing blocks. Four movers 81*a*, 82*a* . . . are attached to corresponding drive sliders 51, 52 . . . Stators 91*a* . . . are attached to appropriate mounting plates that are fixed to the head 71, to form eight linear motors 1*a* . . . together with the movers 81*a*, 82*a* . . . . When the head 71 is moved by the drive motor 72, the drive sliders 51, 52 . . . are stopped relative to the head 71 by excitation of the linear motors 1*a* . . . . Alternatively, it is also possible to fix the slider 74 to the head 71 using a suitable brake unit and balancer in order to reduce the electrical power that needs to be supplied to the linear motors 1*a* . . . .

Prior to machining, a tool electrode 76 is positioned extremely close to a workpiece 66 using the drive motor 72. The size of a microscopic machining gap formed between the tool electrode 76 and the workpiece 66 is from a few mm to a few tens of $\mu$m. During machining, a voltage pulse is applied to the microscopic machining gap, and electrical discharge is produced in the machining gap. Material of the workpiece 66 is removed little by little by the discharge. The slider 74 is gradually lowered along the slide path P by the eight linear motors 1*a* . . . in accordance with removal of the workpiece material, in order to maintain the machining gap at a fixed size. The head 71 is kept stationary during machining. In this manner, a cavity 66*a* that is complementary in shape to the tool electrode 76 is formed in the workpiece 66. A device (not illustrated) for supplying fresh dielectric fluid to the machining gap is provided in the electric discharge machine in order to wash fragments that have been removed from the workpiece 66 away from the machining gap. For the same reason, a well known operation called a "jump" is carried out, to drive out most of the used dielectric fluid in the machining gap from the cavity 66*a* by rapidly raising and lowering the tool electrode 76 periodically. The jump operation is carried out by moving the slider 74 vertically using the eight linear motors 1*a* . . . . The jump operation benefits from the speed and acceleration of the linear motors, and fragments retained in the machining gap will be efficiently removed regardless of the shape of the cavity 66*a*. At this time, the drive mechanism of the present invention can impart a large force to the slider 74 without excessively increasing the thrust of the linear motors. This means that a high speed high acceleration jump operation is possible even if a heavy tool electrode 76 is used.

With the illustrated embodiment, the tool electrode 76 is attached to the slider 74 using a tool attachment unit, but it is also possible to attach the workpiece 66 to the slider 74 and fix the tool electrode 76 to the X table 61.

The illustrated embodiment has been chosen in order to best explain the principles of the invention and its practical application. It is intended that the scope of the invention be defined by the claims appended hereto.

What is claimed is:

1. A press having at least two sections, a first section and a second section capable of reciprocal movement in a vertical direction relative to the first section, for making products using a pair of dies, comprises:

a first drive slider, having an inclined sliding surface inclined at a specified angle and a horizontal sliding surface facing a horizontal guide surface formed on one of the at least two sections, movably joined to the one of the at least two sections, a first swash plate, having an inclined guide surface facing the inclined sliding surface, fixed to the other of the at least two sections, and a first linear motor for causing the first drive slider to move along the inclined guide surface of the first swash plate.

2. The press of claim 1, further comprising:

a second drive slider, having an inclined sliding surface inclined at a specified angle and a horizontal sliding surface facing the horizontal guide surface, movably joined to the one of the at least two sections, a second swash plate, having an inclined guide surface facing the inclined sliding surface of the second drive slider, fixed to the other of the at least two sections, and a second linear motor for causing the second drive slider to move along the inclined guide surface of the second swash plate.

3. The press of claim 2, wherein the first and second drive sliders are arranged parallel to each other, and the inclined sliding surfaces of the first and second drive sliders are inclined in opposite directions.

4. The press of claim 2, further comprising:

a third drive slider, having an inclined sliding surface inclined at a specified angle and a horizontal sliding surface facing the horizontal guide surface, movably joined to the one of the at least two sections, a third swash plate, having an inclined guide surface facing the inclined sliding surface of the third drive slider, fixed to the other of the at least two sections, a third linear motor for causing the third drive slider to move along the inclined guide surface of the third swash plate, a fourth drive slider, having an inclined sliding surface inclined at a specified angle and a horizontal sliding surface facing the horizontal guide surface, movably joined to the one of the at least two sections, a fourth swash plate, having an inclined guide surface facing the inclined sliding surface of the fourth drive slider, fixed to the other of the at least two sections, and a fourth linear motor for causing the fourth drive slider to move along the inclined guide surface of the fourth swash plate.

5. The press of claim 4, wherein the first, second, third and fourth drive sliders are arranged in a line parallel to each other, and the inclined sliding surfaces of adjoining drive sliders are inclined in opposite directions.

6. A press having at least two sections, a first section and a second section capable of reciprocal movement in a vertical direction relative to the first section, for making products using a pair of dies, comprises:

a first drive slider, having an inclined sliding surface inclined at a specified angle and a horizontal sliding surface facing a horizontal guide surface formed on one of the at least two sections, movably joined to the one of the at least two sections, a first swash plate, having an inclined guide surface facing the inclined sliding surface, fixed to the other of the at least two sections, and a first linear motor for causing the first drive slider to move along the inclined guide surface of the first swash plate, wherein the first drive slider is equipped with a guide rail on the horizontal sliding surface, and the one of the at least two sections is equipped on the horizontal guide surface with a bearing block which engages the guide rail.

7. A press having at least two sections, a first section and a second section capable of reciprocal movement in a vertical direction relative to the first section, for making products using a pair of dies, comprises:

a first drive slider, having an inclined sliding surface inclined at a specified angle and a horizontal sliding surface facing a horizontal guide surface formed on one of the at least two sections, movably joined to the one of the at least two sections, a first swash plate, having an inclined guide surface facing the inclined sliding surface, fixed to the other of the at least two sections, and a first linear motor for causing the first drive slider to move along the inclined guide surface of the first swash plate, wherein the first drive slider is equipped with a guide rail on the inclined sliding surface, and the first swash plate is equipped on the inclined guide surface with a bearing block which engages the guide rail.

8. A press having at least two sections, a first section and a second section capable of reciprocal movement in a vertical direction relative to the first section, for making products using a pair of dies, comprises:

a first drive slider, having an inclined sliding surface inclined at a specified angle and a horizontal sliding surface facing a horizontal guide surface formed on one of the at least two sections, movably joined to the one of the at least two sections, a first swash plate, having an inclined guide surface facing the inclined sliding surface, fixed to the other of the at least two sections, and a first linear motor for causing the first drive slider to move along the inclined guide surface of the first swash plate, wherein the second section includes a slide to which one of the pair of dies is mounted, a moving body to which the first drive slider is joined so as to move along the horizontal guide surface, and a plurality of vertically extending guide posts to which the slide and the moving body are fixed.

9. The press of claim 8, wherein the first section includes a bolster to which the other of the pair of dies is mounted, a machine frame to which the bolster and the first swash plate are fixed, and linear motion bearings which are attached to the machine frame for vertically guiding the plurality of guide posts.

10. The press of claim 9, further comprising at least one spring provided between the machine frame and each of the guide posts for applying preload.

11. A press having at least two sections, a first section and a second section capable of reciprocal movement along a linear slide path relative to the first section, for making products using a pair of dies, comprises:

a first swash plate, having a first inclined guide surface inclined at a specified angle to a guide plane which is formed on one of the at least two sections and makes the slide path a right angle, fixed to the other of the at least two sections, a first drive slider, having a first inclined sliding surface facing the first inclined guide surface, joined to the one of the at least two sections so as to move along the guide plane, and a first linear motor for causing the first drive slider to move along the first inclined guide surface.

12. The press of claim 11, further comprising:

a second swash plate, having a second inclined guide surface inclined at a specified angle to the guide plane, fixed to the other of the at least two sections, a second drive slider, having a second inclined sliding surface facing the second inclined guide surface, joined to the one of the at least two sections so as to move along the guide plane, and a second linear motor for causing the second drive slider to move along the second inclined guide surface.

13. The press of claim 12, wherein the first and second drive sliders are arranged parallel to each other, and the first and second inclined sliding surfaces are inclined in opposite directions.

14. The press of claim 12, further comprising:

a third swash plate, having a third inclined guide surface inclined at a specified angle to the guide plane, fixed to the other of the at least two sections, a third drive slider, having a third inclined sliding surface facing the third inclined guide surface, joined to the one of the at least two sections so as to move along the guide plane, a third linear motor for causing the third drive slider to move along the third inclined guide surface, a fourth swash plate, having a fourth inclined guide surface inclined at a specified angle to the guide plane, fixed to the other of the at least two sections, a fourth drive slider, having a fourth inclined sliding surface facing the fourth inclined guide surface, joined to the one of the at least two sections so as to move along the guide plane, and a fourth linear motor for causing the fourth drive slider to move along the fourth inclined guide surface.

15. The press of claim 14, wherein the first, second, third and fourth drive sliders are arranged in a line parallel to each other, and the inclined sliding surfaces of adjoining drive sliders are inclined in opposite directions.

16. A press having at least two sections, a first section and a second section capable of reciprocal movement along a linear slide path relative to the first section, for making products using a pair of dies, comprises:

a first swash plate, having a first inclined guide surface inclined at a specified angle to a guide plane which is formed on one of the at least two sections and makes the slide path a right angle, fixed to the other of the at least two sections, a first drive slider, having a first inclined sliding surface facing the first inclined guide surface, joined to the one of the at least two sections so as to move along the guide plane, and a first linear motor for causing the first drive slider to move along the first inclined guide surface, wherein the first drive slider is equipped with a guide rail on the first inclined sliding surface, and the first swash plate is equipped on the first inclined guide surface with a bearing block which engages the guide rail.

17. A machine tool having at least two sections, a first section and a second section capable of reciprocal movement along a linear slide path relative to the first section, for making products by removing material from the workpiece using a tool, comprises:

a first swash plate, having a first inclined guide surface inclined at a specified angle to a guide plane which is formed on one of the at least two sections and makes the slide path a right angle, fixed to the other of the at least two sections, a first drive slider, having a first inclined sliding surface facing the first inclined guide surface, joined to the one of the at least two sections so as to move along the guide plane, and a first linear motor for causing the first drive slider to move along the first inclined guide surface.

18. The machine tool of claim 17, further comprising:

a second swash plate, having a second inclined guide surface inclined at a specified angle to the guide plane, fixed to the other of the at least two sections, a second drive slider, having a second inclined sliding surface facing the second inclined guide surface, joined to the one of the at least two sections so as to move along the guide plane, and a second linear motor for causing the second drive slider to move along the second inclined guide surface.

19. The machine tool of claim 18, wherein the first and second drive sliders are arranged parallel to each other, and the first and second inclined sliding surfaces are inclined in opposite directions.

20. The machine tool of claim 18, further comprising:

a third swash plate, having a third inclined guide surface inclined at a specified angle to the guide plane, fixed to the other of the at least two sections, a third drive slider, having a third inclined sliding surface facing the third inclined guide surface, joined to the one of the at least two sections so as to move along the guide plane, a third linear motor for causing the third drive slider to move along the third inclined guide surface, a fourth swash plate, having a fourth inclined guide surface inclined at a specified angle to the guide plane, fixed to the other of the at least two sections, a fourth drive slider, having a fourth inclined sliding surface facing the fourth inclined guide surface, joined to the one of the at least two sections so as to move along the guide plane, and a fourth linear motor for causing the fourth drive slider to move along the fourth inclined guide surface.

21. The machine tool of claim 20, wherein the first, second, third and fourth drive sliders are arranged in a line parallel to each other, and the inclined sliding surfaces of adjoining drive sliders are inclined in opposite directions.

22. A machine tool having at least two sections, a first section and a second section capable of reciprocal movement along a linear slide path relative to the first section, for making products by removing material from the workpiece using a tool, comprises:

a first swash plate, having a first inclined guide surface inclined at a specified angle to a guide plane which is formed on one of the at least two sections and makes the slide path a right angle, fixed to the other of the at least two sections, a first drive slider, having a first inclined sliding surface facing the first inclined guide surface, joined to the one of the at least two sections so as to move along the guide plane, and a first linear motor for causing the first drive slider to move along the first inclined guide surface, wherein the first drive slider is equipped with a guide rail on the first inclined sliding surface, and the first swash plate is equipped on the first inclined guide surface with a bearing block which engages the guide rail.

23. A machine tool having at least two sections, a first section and a second section capable of reciprocal movement along a linear slide path relative to the first section, for making products by removing material from the workpiece using a tool, comprises:

a first swash plate, having a first inclined guide surface inclined at a specified angle to a guide plane which is formed on one of the at least two sections and makes the slide path a right angle, fixed to the other of the at least two sections, a first drive slider, having a first inclined sliding surface facing the first inclined guide surface, joined to the one of the at least two sections so as to move along the guide plane, and a first linear motor for causing the first drive slider to move along the first inclined guide surface, wherein the first section includes a head having a slide hole and the second section includes a slider which can slide within the slide hole.

24. The machine tool of claim 23, wherein the second section includes a tool attachment unit to which one of the tool and the workpiece is attached, the tool attachment unit is fixed to the slider.

* * * * *